US005274991A

United States Patent [19]

Fitts

[11] Patent Number: 5,274,991

[45] Date of Patent: Jan. 4, 1994

[54] DRY LOW NOX MULTI-NOZZLE COMBUSTION LINER CAP ASSEMBLY

[75] Inventor: David O. Fitts, Charlton, N.Y.

[73] Assignee: General Electric Company, Schenectady, N.Y.

[21] Appl. No.: 859,007

[22] Filed: Mar. 30, 1992

[51] Int. Cl.[5] ..... F23R 3/32; F02C 7/20

[52] U.S. Cl. ..... 60/39.32; 60/39.37; 60/737

[58] Field of Search ..... 60/39.37, 39.32, 732, 60/733, 737, 738, 740, 742, 746, 747, 748

[56] References Cited

U.S. PATENT DOCUMENTS

| | | | |
|---|---|---|---|
| 2,676,460 | 4/1954 | Brown | 60/39.65 |
| 3,086,363 | 4/1963 | Fiori | 60/39.37 |
| 4,009,569 | 3/1977 | Kozlin | 60/39.32 |
| 4,100,733 | 7/1978 | Striebel et al. | 60/737 |
| 4,255,927 | 3/1981 | Johnson et al. | 60/39.37 |
| 4,292,801 | 10/1981 | Wilkes et al. | 60/39.06 |
| 4,365,470 | 12/1982 | Matthews et al. | 60/39.32 |
| 4,408,461 | 10/1983 | Brühwiler et al. | 60/747 |
| 4,914,918 | 4/1990 | Sullivan | 60/756 |
| 4,967,561 | 11/1990 | Brühwiler et al. | 60/737 |
| 4,982,570 | 1/1991 | Waslo et al. | 60/733 |
| 5,117,636 | 6/1992 | Bechtel, II et al. | 60/738 |

FOREIGN PATENT DOCUMENTS

| | | | |
|---|---|---|---|
| 0095788 | 12/1983 | European Pat. Off. . | |
| 812404 | 4/1959 | United Kingdom | 60/39.37 |

OTHER PUBLICATIONS

"Dry Low NOx Combustion for GE Heavy-Duty Gas Turbines", GE Turbine Reference Library (no date).

*Primary Examiner*—Richard A. Bertsch
*Assistant Examiner*—Timothy S. Thorpe
*Attorney, Agent, or Firm*—Nixon & Vanderhye

[57] ABSTRACT

A modular combustion liner cap assembly (42) for use in a multi-nozzle combustor of a gas turbine includes a substantially cylindrical first sleeve (46) having a rearward end and a forward end; a rear plate (48) fixed to the rearward end of the sleeve (46), the rear plate (48) provided with a first plurality of openings (52) for receiving a corresponding number of fuel nozzles (32); a forward plate subassembly (68) fixed to the forward end of the sleeve (46), the forward plate provided with a second plurality of openings (80) in substantial alignment with the first plurality of openings in the rear plate (48); a plurality of open ended premix tubes having forward and rearward ends, each tube (96) extending axially within the sleeve (46) between the rear plate (48) and the forward plate assembly (68), each premix tube (96) supported within a corresponding one of the first plurality of openings (52) at its rearward end and a corresponding one of the second plurality of openings (80) at its forward end.

24 Claims, 10 Drawing Sheets

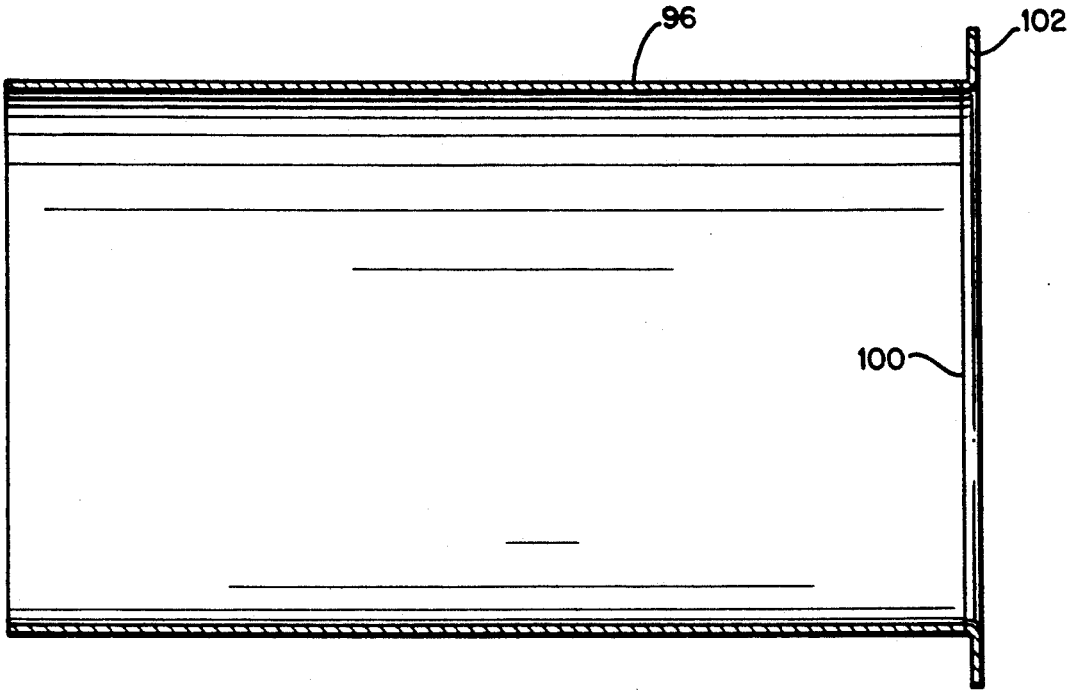
FIG. 7
FIG. 8
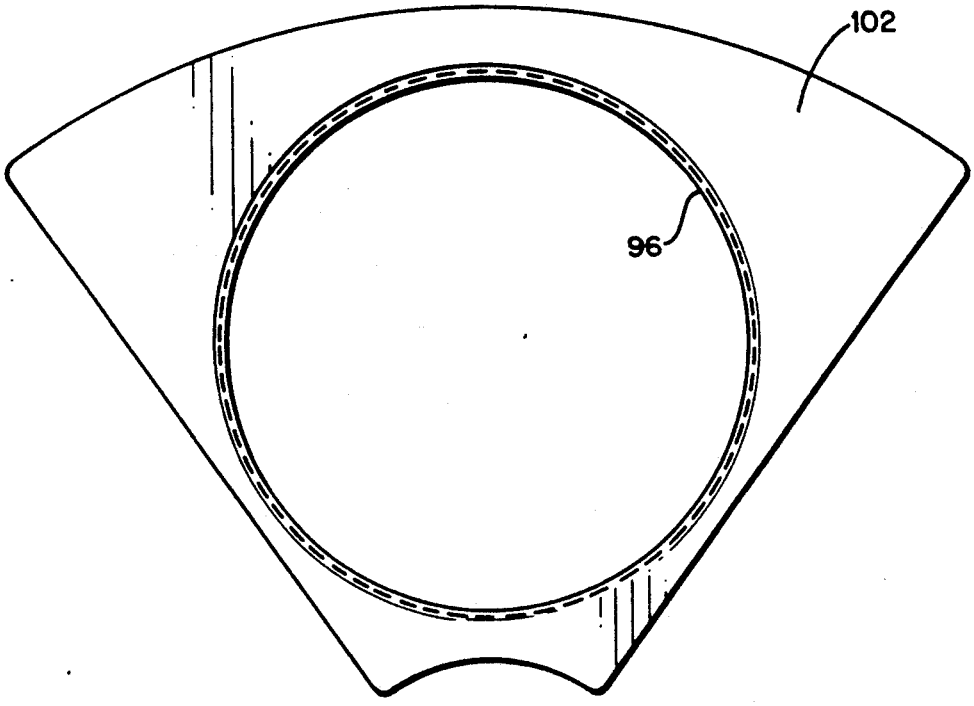

DRY LOW NOX MULTI-NOZZLE COMBUSTION LINER CAP ASSEMBLY

RELATED APPLICATIONS

This application is related generally to commonly owned application Ser. No. 07/859,006 (allowed), filed Mar. 30, 1992, the entirety of which is incorporated herein by reference; and to commonly owned application Ser. Nos. 07/618,246, now abandoned, filed Mar. 22, 1990, and U.S. Pat. No. 4,982,570 and 5,199,265.

TECHNICAL FIELD

This invention relates to gas and liquid fueled turbines, and more specifically, to combustors in industrial gas turbines used in power generation plants.

BACKGROUND ART

Gas turbines generally include a compressor, one or more combustors, a fuel injection system and a turbine. Typically, the compressor pressurizes inlet air which is then turned in direction or reverse flowed to the combustors where it is used to cool the combustor and also to provide air to the combustion process. In a multi-combustor turbine, the combustors are located about the periphery of the gas turbine, and a transition duct connects the outlet end of each combustor with the inlet end of the turbine to deliver the hot products of the combustion process to the turbine.

In an effort to reduce the amount of NOx in the exhaust gas of a gas turbine, inventors Wilkes and Hilt devised the dual stage, dual mode combustor which is shown in U.S. Pat. No. 4,292,801 issued Oct. 6, 1981 to the assignee of the present invention. In this aforementioned patent, it is disclosed that the amount of exhaust NOx can be greatly reduced, as compared with a conventional single stage, single fuel nozzle combustor, if two combustion chambers are established in the combustor such that under conditions of normal operating load, the upstream or primary combustion chamber serves as a premix chamber, with actual combustion occurring in the downstream or secondary combustion chamber. Under this normal operating condition, there is no flame in the primary chamber (resulting in a decrease in the formation of NOx), and the secondary or center nozzle provides the flame source for combustion in the secondary combustor. The specific configuration of the patented invention includes an annular array of primary nozzles within each combustor, each of which nozzles discharges into the primary combustion chamber, and a central secondary nozzle which discharges into the secondary combustion chamber. These nozzles may all be described as diffusion nozzles in that each nozzle has an axial fuel delivery pipe surrounded at its discharge end by an air swirler which provides air for fuel nozzle discharge orifices.

In U.S. Pat. No. 4,982,570, there is disclosed a dual stage, dual mode combustor which utilizes a combined diffusion/premix nozzle as the centrally located secondary nozzle. In operation, a relatively small amount of fuel is used to sustain a diffusion pilot whereas a premix section of the nozzle provides additional fuel for ignition of the main fuel supply from the upstream primary nozzles directed into the primary combustion chamber.

In a subsequent development, a secondary nozzle air swirler previously located in the secondary combustion chamber downstream of the diffusion and premix nozzle orifices (at the boundary of the secondary flame zone), was relocated to a position upstream of the premix nozzle orifices in order to eliminate any direct contact with the flame in the combustor. This development is disclosed in the above identified co-pending '246 application.

Prior multi-nozzle cap assemblies utilize welded sheet metal fabrications which are very labor and tooling intensive to make. Once assembled, these cap assemblies are difficult to repair or rework, and in some instances, if damaged, repair or rework cannot be economically justified and the cap must be scrapped.

DISCLOSURE OF INVENTION

This invention relates generally to a new dry low NOx combustor specifically developed for industrial gas turbine applications, as described in the above noted copending application Ser. No. 07/859,006. The combustor is a single stage (single combustion or burning zone) dual mode (diffusion and premixed) combustor which operates in a diffusion mode at low turbine loads and in a premixed mode at high turbine loads. Generally, each combustor includes multiple fuel nozzles, each of which is similar to the diffusion/premix secondary nozzle as disclosed in the '246 patent application. In other words, each nozzle has a surrounding dedicated premix section or tube so that, in the premixed mode, fuel is premixed with air prior to burning in the single combustion chamber. In this way, the multiple dedicated premixing sections or tubes allow thorough premixing of fuel and air prior to burning, which ultimately results in low NOx levels.

More specifically, each combustor includes a generally cylindrical casing having a longitudinal axis, the combustor casing having fore and aft sections secured to each other, and the combustion casing as a whole secured to the turbine casing. Each combustor also includes an internal flow sleeve and a combustion liner substantially concentrically arranged within the flow sleeve. Both the flow sleeve and combustion liner extend between a double walled transition duct at their forward or downstream ends, and a sleeve cap assembly (located within a rearward or upstream portion of the combustor) at their rearward ends. The flow sleeve is attached directly to the combustor casing, while the liner receives the liner cap assembly which, in turn, is fixed to the combustor casing. The outer wall of the transition duct and at least a portion of the flow sleeve are provided with air supply holes over a substantial portion of their respective surfaces, thereby permitting compressor air to enter the radial space between the combustion liner and the flow sleeve, and to be reverse flowed to the rearward or upstream portion of the combustor where the air flow direction is again reversed to flow into the rearward portion of the combustor and towards the combustion zone.

A plurality (five in the exemplary embodiment) of diffusion/premix fuel nozzles are arranged in a circular array about the longitudinal axis of the combustor casing. These nozzles are mounted in a combustor end cover assembly which closes off the rearward end of the combustor. Inside the combustor, the fuel nozzles extend into a combustion liner cap assembly and, specifically, into corresponding ones of the premix tubes. The forward or discharge end of each nozzle terminates within a corresponding premix tube, in relatively close proximity to the downstream end of the premix tube which opens to the burning zone in the combustion liner. An air swirler is located radially between each nozzle and its associated premix tube at the rearward or upstream end of the premix tube, to swirl the compressor air entering into the respective premix tube for mixing with premix fuel, as described in greater detail in co-pending application Ser. No. 07/859,006.

Each fuel nozzle is provided with multiple concentric passages for introducing premix gas fuel, diffusion gas fuel, combustion air, water (optional), and liquid fuel into the combustion or burning zone. The nozzle construction per se forms no part of this invention. The gas and liquid fuels, combustion air and water are supplied to the combustor by suitable supply tubes, manifolds and associated controls which are well understood by those skilled in the art.

This new dry low NOx combustor disclosed in the above noted application Ser. No. 07/859,006 has created a need for:

"Float" between the liner cap assembly and the fuel nozzles to prevent interference due to manufacturing tolerance stack-up;

Compliance between the liner cap assembly and liner assembly;

Firm attachment of the liner cap assembly to the combustion case to reduce wear and vibration;

Economical repair or replacement of damaged parts; and

Maintenance or improvement of the emissions performance of current dry low NOx combustors while meeting all mechanical design requirements for production liner cap assemblies, among other requirements.

The present invention, in seeking to solve the above problems, utilizes a modular construction technique which allows for rapid design changes to be made to components of the cap assembly with minimal impact upon the total cap assembly, and allows for economical repairs to be made to cap assemblies due to manufacturing mistakes during initial construction or due to in-service damage. Additionally, the cap assembly in accordance with this invention requires minimal special forming tools which further reduces manufacturing cycle time and cost. Thus, this invention is related specifically to the construction of the combustion liner cap assembly and associated premix tubes, and the manner in which the combustion liner cap assembly is supported within the combustor.

The combustion liner cap assembly in accordance with this invention includes a substantially cylindrical first sleeve to which is secured a rear plate. The plate is generally circular in shape and is welded to the rearward peripheral edge of the sleeve. The rear plate is also formed with a plurality of relatively large openings (five in the exemplary embodiment), one for each fuel nozzle assembly, as described in further detail below.

Each fuel nozzle opening is fitted with a floating nozzle collar, extending rearwardly of the rear plate. The assembly is configured and arranged to retain the nozzle collar against the rear plate, but to allow free-floating radial adjustment of the collar to accommodate any slight misalignment (or tolerance build up) of the fuel nozzle relative to the liner cap assembly.

The forward or downstream end of the first cylindrical sleeve terminates at a free, annular edge. The opening defined by the forward edge of the sleeve receives an impingement plate subassembly which includes a forward wall or impingement plate provided with a plurality of cooling apertures, and a rearwardly extending outer cylindrical extension. The impingement plate is also formed with a plurality of openings (i.e., five) in axial alignment with the rear plate openings. Each of the impingement plate openings is further defined by an inner axially (rearwardly) extending ring welded to the impingement plate. The outer cylindrical extension of the impingement plate assembly is received within and riveted to the forward end of the first sleeve.

A central opening in the impingement plate has a rearwardly extending cylindrical inner ring fixed thereto, for receiving a center cup. The cup, like the impingement plate, has a plurality of cooling apertures therein, and is used to "plug" the center opening of the impingement plate when, since in the exemplary embodiment of this invention, no secondary center body fuel nozzle is employed.

Each pair of aligned rear plate and impingement plate openings receives a premix tube, extending substantially perpendicularly between the plates. The premix tube is a solid, open ended cylinder, a rearward edge of which fits within a counterbore in the rear plate. The forward edge of the premix tube is telescoped within the inner ring of the impingement plate assembly. The forward edge of each premix tube may be provided with a radially directed, substantially wedge-shaped shield plate. The shield plates of the five premix tubes, in combination, shield substantially the entire impingement plate from the thermal radiation of the combustor flame. By not welding or otherwise fixing the forward ends of the premix tubes to the impingement plate assembly, removal of the entire premix tube subassembly (the five premix tubes, the rear plate and floating collars) for repair and/or replacement can be accomplished without removing (or damaging) the remainder of the cap assembly.

Added support for the premix tube subassembly is provided by an internal strut subassembly which includes an annular center ring fitted about the rearwardly extending inner ring of the impingement plate, and five radially oriented spokes or struts extending between the premix tubes to an outer annular ring fixed to the interior surface of the first sleeve.

The multi-nozzle liner cap assembly in accordance with this invention is secured within the combustor casing in the following manner. The combustor casing has fore and aft sections, joined together in a conventional manner by bolts at annular abutting flanges. The respective flanges are provided with opposed annular recesses. The fore section flange recess receives a rearward radial flange of the flow sleeve, while the aft section flange recess receives an annular radial flange of the liner cap mounting flange subassembly.

The liner cap mounting flange subassembly includes a second cylindrical sleeve portion extending rearwardly of the above mentioned annular radial flange. The first and second sleeves are radially spaced from each other in a substantially concentric relationship, with the second sleeve secured to the first sleeve by means of a plurality of circumferentially spaced struts fixed between the first and second sleeves, permitting compressor air to flow past the cap assembly before reversing direction and flowing into the premixed tube subassembly for mixing with premix gas fuel.

This second sleeve incorporates the radial mounting flange which is sandwiched between the fore and aft sections of the combustor casing. The radially inner portion of the annular mounting flange supports a plurality (three in the exemplary embodiment) of combustion liner stops which extend forwardly of the mounting flange. These stops prevent the combustion liner from expanding rearwardly as a result of the heat of combustion, as described further below.

It may therefore be appreciated that in its broader aspects, the present invention comprises a combustion liner cap assembly for use in multi-nozzle combustors of a gas turbine comprising a substantially cylindrical first sleeve having a rearward end and a forward end; a rear plate fixed to the rearward end of the sleeve, the rear plate provided with a first plurality of openings for receiving a corresponding number of fuel nozzles; a forward plate assembly fixed to the forward end of the sleeve, said forward plate provided with a second plurality of openings in substantial alignment with the first plurality of openings in the rear plate; and a plurality of open ended premix tubes having forward and rearward ends, the tubes extending axially within the sleeve between the rear plate and the forward plate assembly, each premix tube supported within a corresponding one of the first plurality of openings at its rearward end and a corresponding one of the second plurality of openings at its forward end.

The present invention thus provides an economical and easy to assemble/disassemble combustion liner cap assembly which has a short manufacturing cycle time and low manufacturing cost resulting from simple subassemblies which require minimal tooling and which are not labor intensive.

Additional objects and advantages of the present invention will become apparent from the detailed description which follows.

BRIEF DESCRIPTION OF THE DRAWINGS

FIG. 7 is a side cross section of a premix tube and associated shield plate incorporated in the combustion liner cap assembly illustrated in FIG. 2;

FIG. 8 is a front end view of the premix tube illustrated in FIG. 7;

BEST MODE FOR CARRYING OUT THE INVENTION

Figure 1:
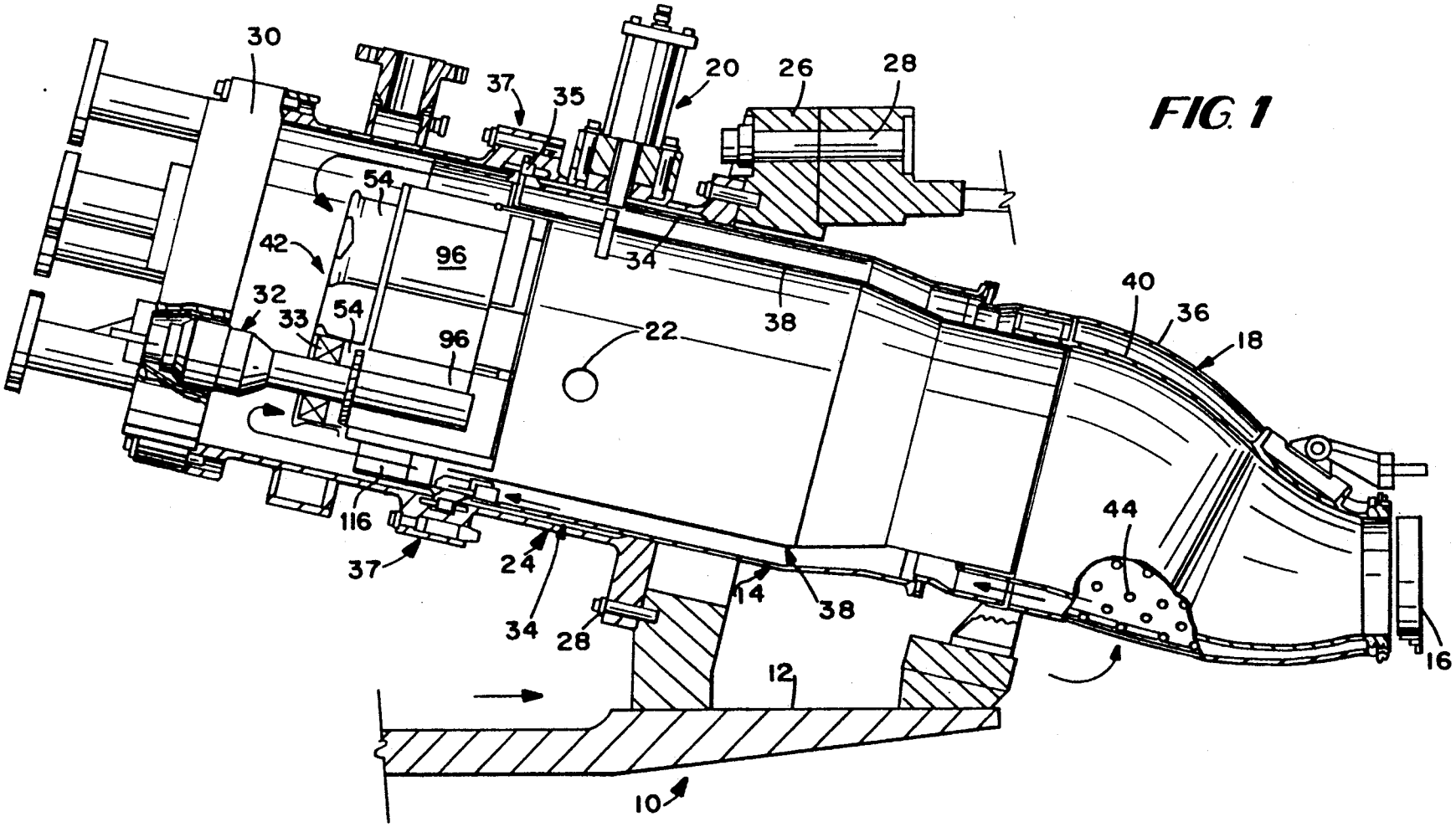
FIG. 1 is a partial cross section of a gas turbine combustor in accordance with an exemplary embodiment of the invention.

With reference to FIG. 1, the gas turbine 10 includes a compressor 12 (partially shown), a plurality of combustors 14 (one shown), and a turbine represented here by a single blade 16. Although not specifically shown, the turbine is drivingly connected to the compressor 12 along a common axis. The compressor 12 pressurizes inlet air which is then reverse flowed to the combustor 14 where it is used to cool the combustor and to provide air to the combustion process.

As noted above, the gas turbine includes a plurality of combustors 14 located about the periphery of the gas turbine. A double-walled transition duct 18 connects the outlet end of each combustor with the inlet end of the turbine to deliver the hot products of combustion to the turbine.

Ignition is achieved in the various combustors 14 by means of spark plug 20 in conjunction with cross fire tubes 22 (one shown) in the usual manner.

Figure 5:
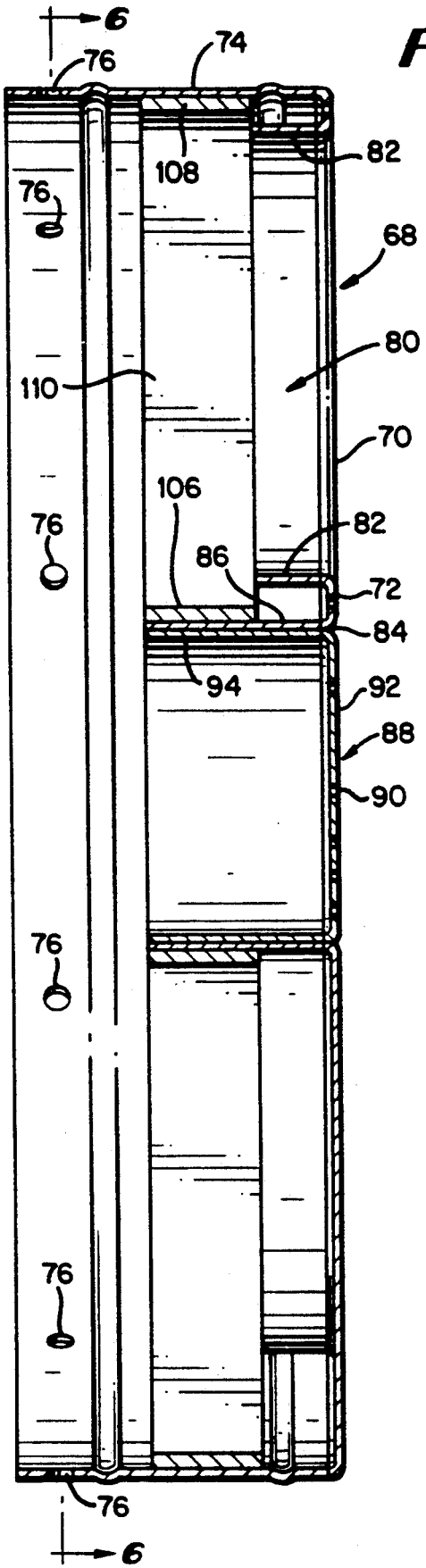
FIG. 5 is a side sectional view of an impingement plate subassembly and support strut subassembly incorporated within the combustion liner cap assembly illustrated in FIG. 2.

Each combustor 14 includes a substantially cylindrical combustion casing 24 which is secured at an open forward end to the turbine casing 26 by means of bolts 28. The rearward end of the combustion casing is closed by an end cover assembly 30 which may include conventional supply tubes, manifolds and associated valves, etc. for feeding gas, liquid fuel and air (and water if desired) to the combustor. The end cover assembly 30 receives a plurality (for example, five) fuel nozzle assemblies 32 (only one shown for purposes of convenience and clarity) arranged in a circular array (see FIG. 5) about a longitudinal axis of the combustor.

Within the combustor casing 24, there is mounted, in substantially concentric relation thereto, a substantially cylindrical flow sleeve 34 which connects at its forward end to the outer wall 36 of the double walled transition duct 18. The flow sleeve 34 is connected at its rearward end by means of a radial flange 35 to the combustor casing 24 at a butt joint 37 where fore and aft sections of the combustor casing 24 are joined.

Within the flow sleeve 34, there is a concentrically arranged combustion liner 38 which is connected at its forward end with the inner wall 40 of the transition duct 18. The rearward end of the combustion liner is supported by a combustion liner cap assembly 42 as described further below, and which, in turn, is secured to the combustor casing at the same butt joint 37. It will be appreciated that the outer wall 36 of the transition duct 18, as well as that portion of flow sleeve 34 extending forward of the location where the combustion casing 24 is bolted to the turbine casing (by bolts 28) are formed with an array of apertures 44 over their respective peripheral surfaces to permit air to reverse flow from the compressor 12 through the apertures 44 into the annular (radial) space between the flow sleeve 34 and the liner 36 toward the upstream or rearward end of the combustor (as indicated by the flow arrows shown in FIG. 1).

The combustion liner cap assembly 42 in accordance with this invention will now be described in detail.

Figure 2:
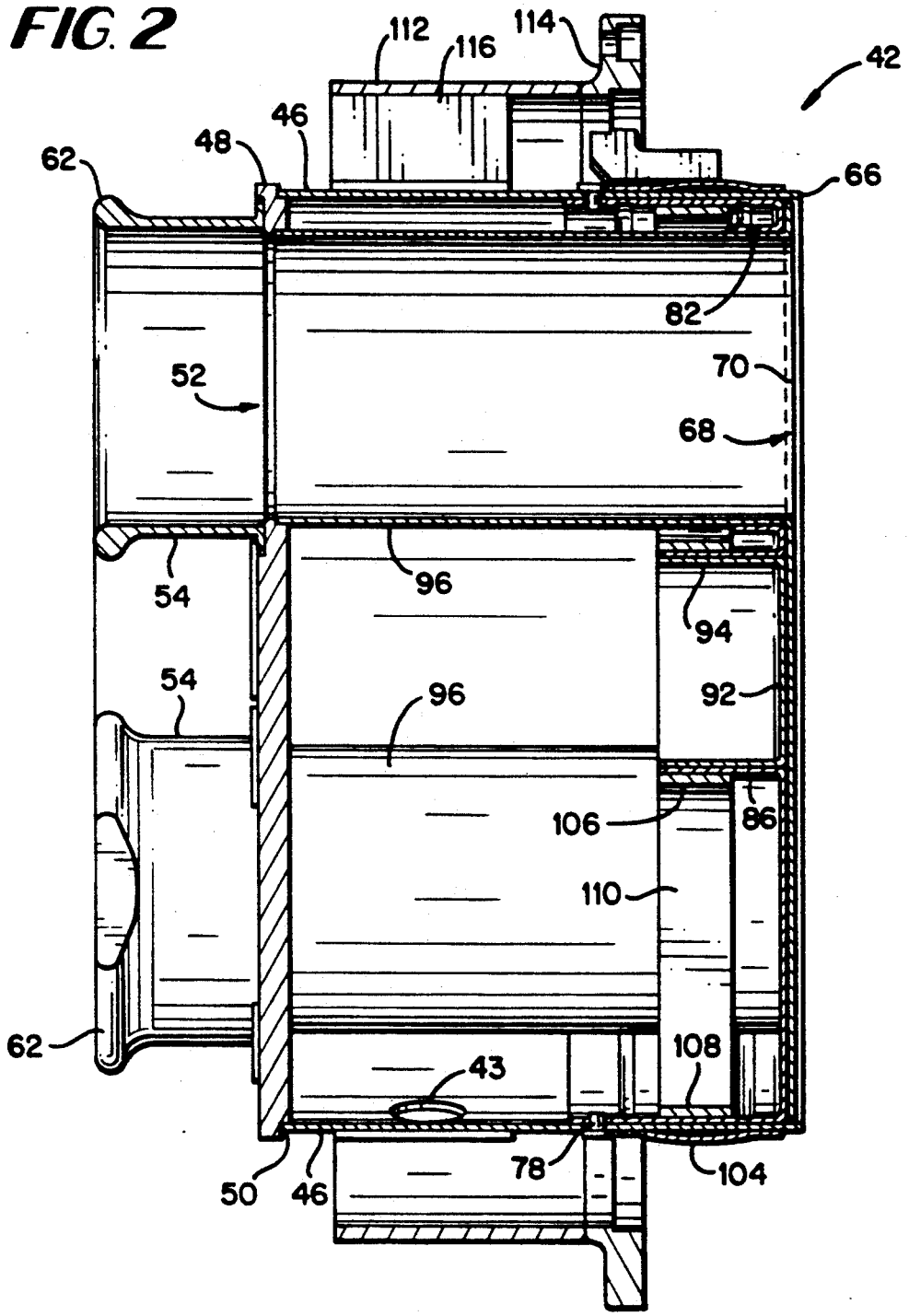
FIG. 2 is a partial cross section of a combustor liner cap assembly incorporated within the combustor illustrated in FIG. 1.

Referring to FIG. 2, the combustion liner cap assembly 42 includes a substantially cylindrical first sleeve 46 to which is secured a rear plate 48. The sleeve is provided with circumferentially spaced cooling holes 43 which permit compressor air to flow into the liner cap assembly as described further below. The plate 46 is generally circular in shape and is welded to the sleeve 46 about its peripheral edge, the plate formed with a shoulder 50 on its forward side adapted to engage the rearward edge of the sleeve 46. The plate is also formed with a plurality of nozzle openings 52 (five in the exemplary embodiment), one for each fuel nozzle assembly.

Figure 2A:
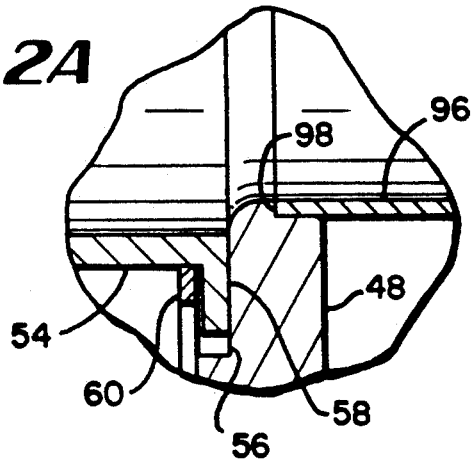
FIG. 2A is an enlarged construction detail of the combustor liner cap assembly illustrated in FIG. 2.
Figure 3:
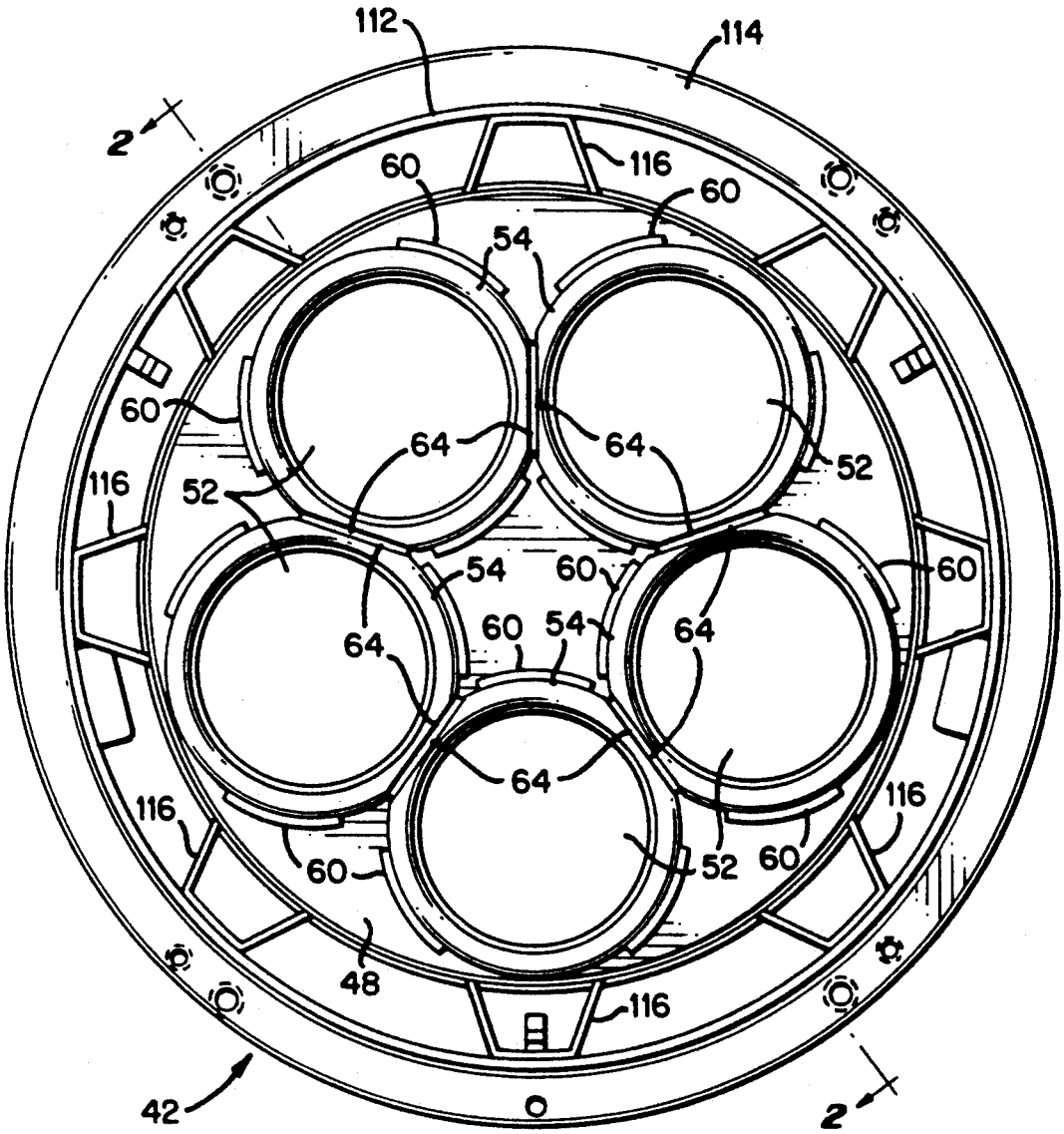
FIG. 3 is a rear end view of the combustion liner cap assembly illustrated in FIG. 2.
Figure 4:
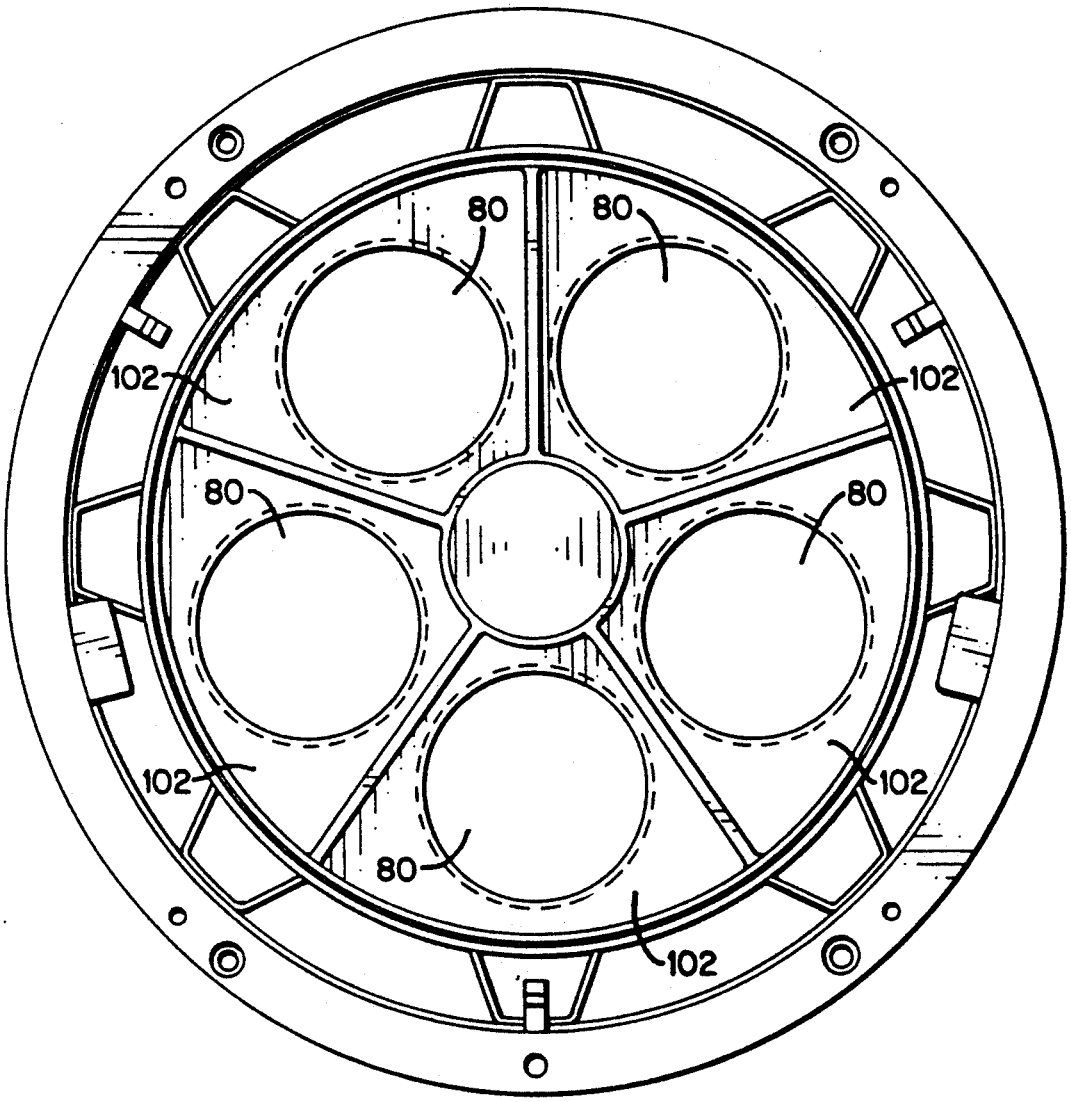
FIG. 4 is a front end view of the combustor liner cap assembly of FIG. 1.

Each fuel nozzle opening 52 in plate 48 is fitted with a floating collar 54, extending rearwardly of the plate 48. As best seen in FIGS. 2 and 2A, each nozzle opening formed in the plate 48 is surrounded by a recessed shoulder 56 which is designed to loosely receive a radial flange 58 formed on the forward peripheral edge of the associated collar 54. Once properly located, a plurality of tabs 60 (three in the exemplary embodiment) are fixed to the rearward edge of the plate 48 (equally spaced about its periphery) so as to overlap the collar radial flange 58, thereby retaining the collar 54 in place, but permitting slight radial adjustment thereof to accommodate slight misalignment of the associated fuel nozzle 32 (and associated swirler 33) and/or tolerance build up between the various combustor components. The rearwardmost edge 62 of each floating collar 54 is formed with an enlarged radius portion, flattened at two locations 64, where the collar 54 abuts adjacent, similar collars, best seen in FIG. 3. The floating collars 54 are removable and replaceable as necessary when wear occurs between the collar and the fuel nozzle.

Figure 2B:
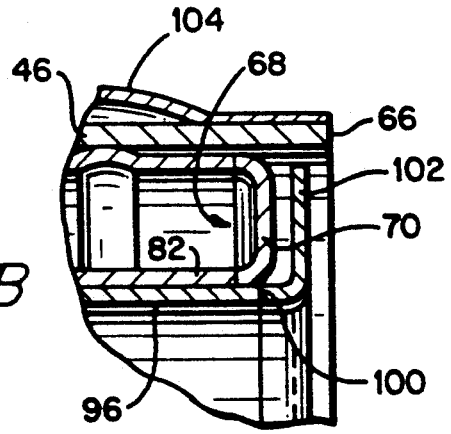
FIG. 2B is another enlarged construction detail of the combustor liner cap assembly illustrated in FIG. 2.
Figure 6:
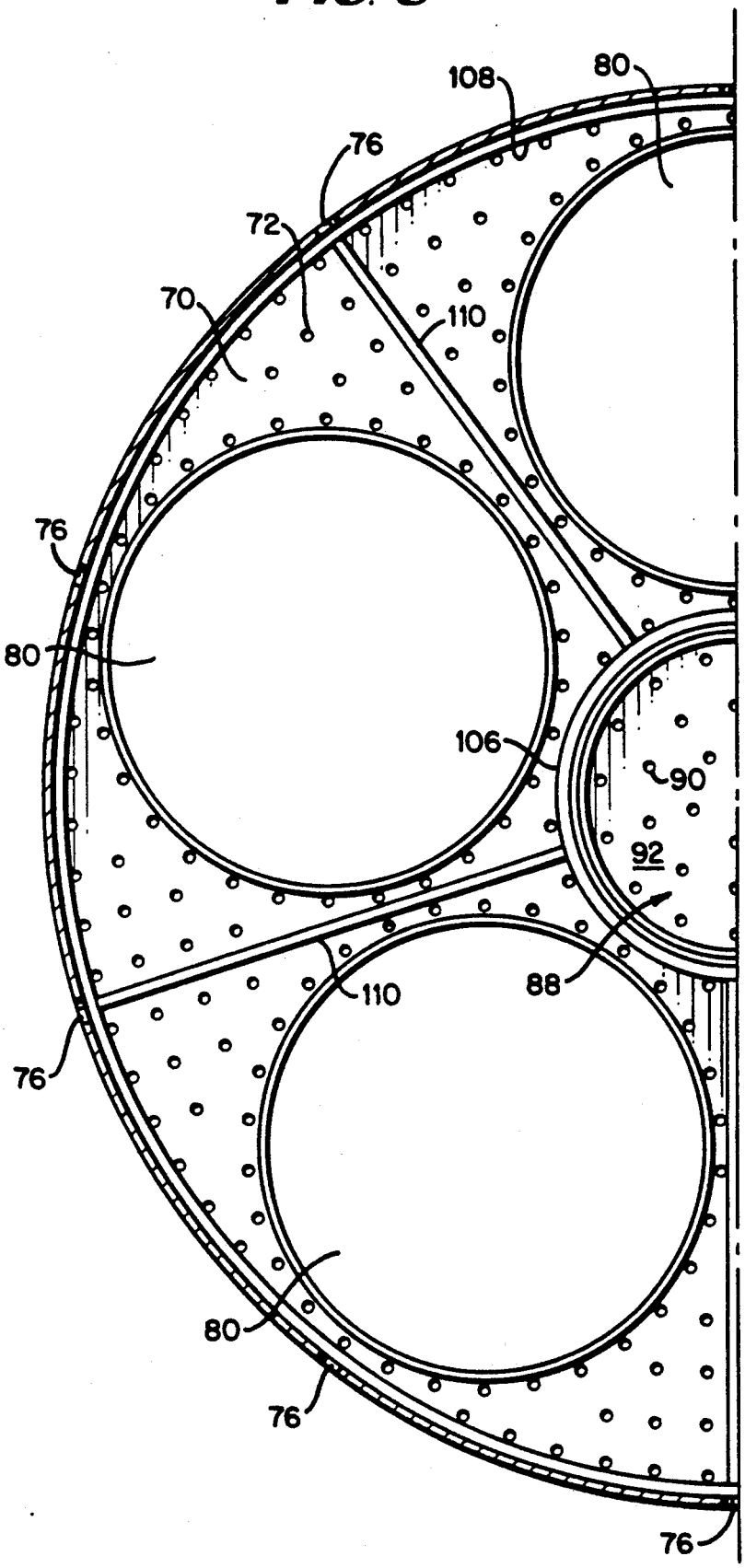
FIG. 6 is a partial front end view of the impingement plate subassembly illustrated in FIG. 5.
Figure 9:
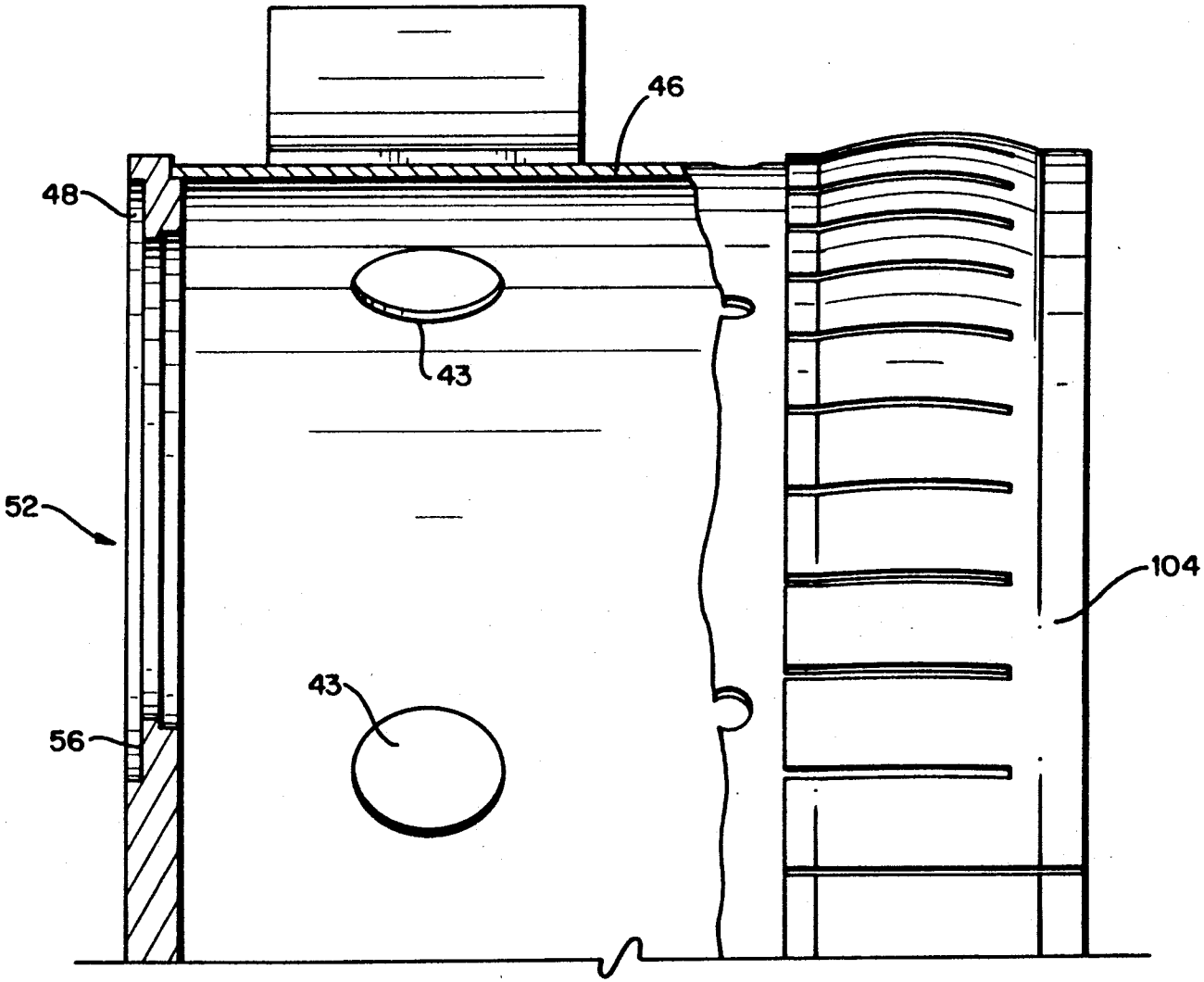
FIG. 9 is a partial side section of portions of the combustion liner cap assembly illustrated in FIG. 1.

The forward or downstream end of the first cylindrical sleeve 46 terminates at a free, annular edge 66 (best seen in FIG. 2B). The opening defined by the forward edge 66 of the sleeve 46 receives an impingement plate subassembly 68. The subassembly 68, best seen in FIGS. 5 and 6 with additional reference to FIGS. 2 and 2B includes a forward wall or impingement plate 70, provided with a plurality of cooling apertures 72, and a rearwardly extending outer cylindrical extension 74 (also referred to as a "third" sleeve) which is riveted (by means of shear pins) to the sleeve 46 as shown at 78 in FIG. 2. The impingement plate 70 is also formed with a plurality of nozzle openings 80 (i.e., five) in axial alignment with the nozzle openings 52 in the rear plate 48. Each of the nozzle openings 80 is defined by an inner axially extending ring 82 welded to the impingement plate 70.

A central opening 84 in the impingement plate 70 has a rearwardly extending annular ring (or "fourth sleeve") 86 welded thereto, for receiving a center cup 88. The cup 88, like the impingement plate 70, has a plurality of cooling apertures 90 on a front face 92 thereof, and is used to "plug" the center of the impingement plate 70 when, as in the exemplary embodiment of this invention, no center body fuel nozzle is employed. The center cup 88 is provided with a "sidewall" 94 which is telescopically received within the ring 86 and fixed thereto by, for example, welding or other suitable means.

Each pair of axially aligned rear plate nozzle openings 52 and impingement plate nozzle openings 80 receive a premix tube 96. Each premix tube 96 is a solid, open ended cylinder, a rearward edge of which fits within a counterbore 98 in the rear plate 48 (see FIG. 2A). The forward edge 100 of the premix tube 96 is telescoped within the inner ring 82 of the impingement plate subassembly 68 and extends axially beyond (i.e., downstream or forwardly of) the impingement plate 70 (see FIG. 2B). A small annular gap between the outer diameter of the premix tubes and their respective openings in the impingement plate steadies the premix cups and prevents uncontrolled air flow into the combustion liner. The forward end of the premix tubes 96 are not fixed to the impingement plate assembly 68, however, thereby facilitating removal of the entire premix tube subassembly (made up of the five premix tubes 96, the rear plate 48 and floating collars 54) for repair and/or replacement without also removing (or damaging) the remainder of the liner cap assembly.

With reference to FIGS. 2B, 4, 7 and 8, a plurality of wedge-shaped shield plates 102 may be secured to the respective forward edges 100 of the premix tubes 96. Collectively, the shield plates 102 provide substantial protection for the impingement plate 70 against the thermal radiation of the combustor flame to keep the temperature of the liner cap assembly within acceptable limits. In this regard, the shield plates are cooled by air flowing through the cooling apertures 72 in the impingement plate 70. The shield plates may be secured to the premix cups by any suitable means but, in order to preserve the feature of easy removal of the premix tube subassembly, the shield plates 102 must be from the premix tubes 96. The use of shield plates is optional, however, so that no substantial obstacle to the modular construction of the liner assembly is necessarily established. In any event, where shield plates are employed, the size and shape are determined for each application of the cap assembly by thermal stress analysis and testing. A further benefit which accrues from the use of shield plates is that they serve to create a bluff body effect which assists in stabilizing the flame in the combustor.

An annular leaf spring 104 is secured about the forward portion of the sleeve 46, and is adapted to engage the inner surface of the combustion liner 38 when the liner cap assembly 42 is inserted within the rearward end of the liner.

In order to provide additional support for the premix cup and impingement plate subassemblies, a support strut subassembly is provided which includes an inner ring 106, an outer ring 108 and a plurality of radial spokes or struts 110 extending therebetween. The inner ring 106 is fixed about the annular ring (or fourth sleeve) 86 of the impingement plate subassembly 68, while the outer ring 108 is fixed to the interior surface of the outer cylindrical extension (or third sleeve) 74 of the impingement plate subassembly.

The multi-nozzle liner cap assembly 42 in accordance with this invention is secured within the combustor casing by means of a mounting flange subassembly which includes a cylindrical ring portion (also referred to as a "second sleeve") 112 extending rearwardly of an annular mounting flange ring 114 and radially spaced from the sleeve 46. The cylindrical ring is secured to the sleeve by means of a plurality of circumferentially spaced struts 116 welded to both the sleeve 46 and the cylindrical ring portion 112.

Returning to FIG. 1, the flange 114 is sandwiched between the combustor casing flanges at the joint 37, adjacent the flow sleeve flange 35.

Figure 10:
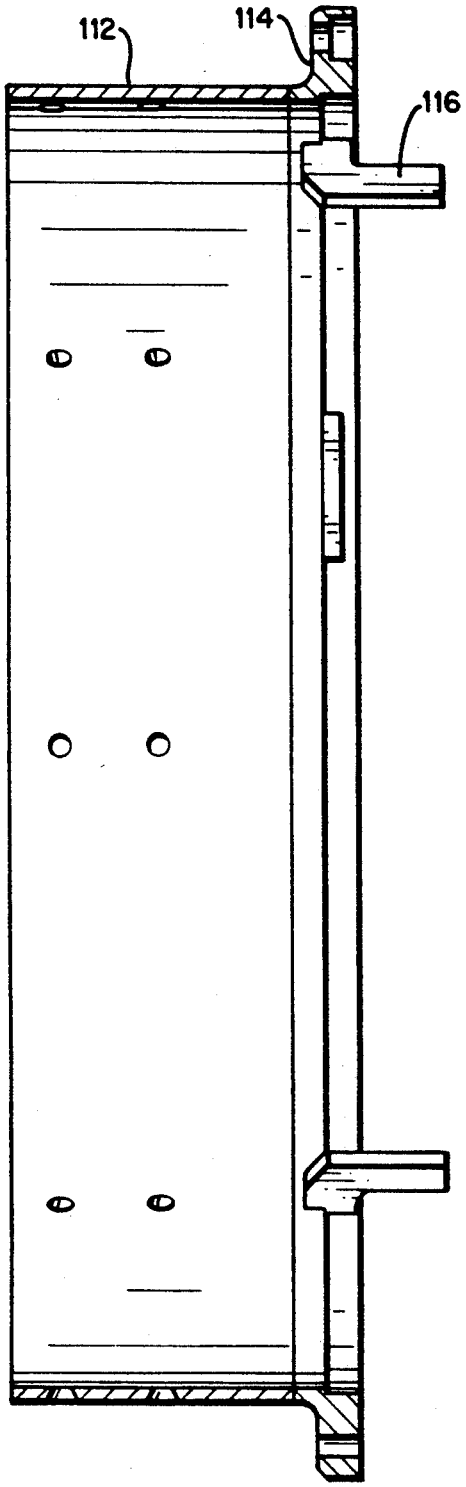
FIG. 10 is a side cross section of an outer sleeve and mounting flange subassembly incorporated within the combustion liner cap assembly of FIG. 1.
Figure 10A:
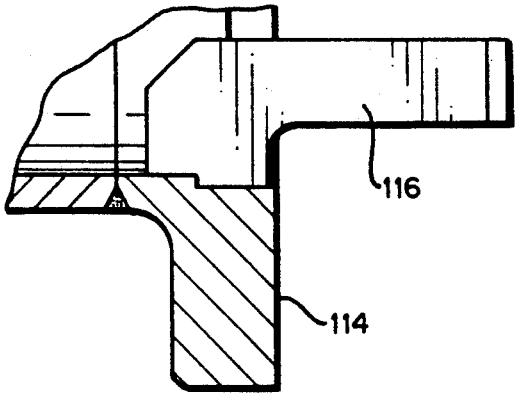
FIG. 10A is an enlarged construction detail of the outer sleeve and mounting flange subassembly illustrated in FIG. 10.

With reference to FIGS. 10 and 10A, the mounting flange ring 114 is provided on its inner surface with a plurality (three in the exemplary embodiment) of combustion liner stops 118 which extend forwardly of the flange ring, and are adapted to engage the end of the associated combustion liner 38 to thereby prevent the liner from expanding rearwardly as a result of the heat of combustion. The liner 38 is thus forced to expand forwardly into the transition duct wall 40 and thus avoiding damage to any of the combustor components.

From the above description of the invention, it will become apparent that the invention provides the following advantages over prior combustion cap assemblies:

(1) Economical repair or rework of damaged cap assemblies through the use of readily removable, repairable and/or replaceable cap subassemblies;

(2) Short manufacturing cycle time and low subassemblies which require minimal tooling and are not labor intensive;

(3) The disclosed construction meets acceptable inspection and repair intervals; and (4) Allows for foreseen and unforeseen design upgrades without changing the basis liner cap assembly construction.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustion liner cap assembly for use in a multi-nozzle combustor of a gas turbine comprising:

a substantially cylindrical first sleeve having a rearward end and a forward end;

a rear plate fixed to the rearward end of said sleeve, said rear plate provided with a first plurality of openings for receiving a corresponding number of fuel nozzles;

a forward plate subassembly fixed to the forward end of said sleeve, said forward plate provided with a second plurality of openings in substantial alignment with said first plurality of openings in said rear plate;

a plurality of open ended premix tubes having forward and rearward edges, said tubes extending axially within said sleeve between said rear plate and asia forward plate assembly, each premix tube supported within a corresponding one of said first plurality of openings at its rearward edge and a corresponding one of said second plurality of openings adjacent its forward edge in non-fixed relation thereto.

2. The liner cap assembly of claim 1 wherein said rearward end of each of said premix tubes is supported and fixed within a corresponding one of said first plurality of openings.

3. The liner cap assembly of claim 1 wherein a plurality of nozzle collars extend rearwardly of said rear plate, each aligned with a respective one of said first plurality of openings.

4. The liner cap assembly of claim 3 wherein each of said plurality of nozzle collars are mounted to said rear plate so as to permit movement relative to said rear plate.

5. The liner cap assembly of claim 1 wherein each of said nozzle collars is mounted to said plate by a plurality of retaining tabs fixed to said rear plate.

6. The liner cap assembly of claim 1 wherein said substantially cylindrical first sleeve is secured to a second, substantially cylindrical radially outer sleeve by a plurality of strut components arranged in a circular array between said first and second sleeves.

7. The liner cap assembly of claim 6 wherein said second sleeve includes an annular ring provided with a radial mounting flange for securing said liner cap assembly within the combustor.

8. The liner cap assembly of claim 1 wherein said front plate subassembly comprises an impingement plate formed with a center opening in addition to said second plurality of second openings, and a plurality of coolant apertures arrayed over substantially the entirety of the impingement plate.

9. The liner cap assembly of claim 8 wherein said impingement plate includes a third substantially cylindrical sleeve fixed to and extending rearwardly from said impingement plate, said third sleeve telescopically received within said first sleeve.

10. The liner cap assembly of claim 8 wherein said impingement plate includes a fourth sleeve fixed to and extending rearwardly of said center opening, and a center cup fixed within said fourth sleeve, said center cup having a front face formed with a plurality of cooling apertures.

11. The liner cap assembly of claim 8 wherein said impingement plate is shielded over substantially its entire surface by a plurality of shield plates.

12. The liner cap assembly of claim 11 wherein each premix tube has one of said plurality of shield plates fixed to a forward edge of said premix tube.

13. The liner cap assembly of claim 1 wherein said first sleeve has a plurality of cooling holes spaced about the circumference thereof.

14. The liner assembly of claim 1 and including an annular seal supported on an outer surface of said first sleeve adjacent the forward end thereof and adapted to engage a combustion liner.

15. The liner assembly of claim 14 wherein said second sleeve includes an annular ring provided with a radial mounting flange for securing said liner cap assembly within a combustor.

16. The liner assembly of claim 15 wherein said annular ring mounts a plurality of combustion liner stops.

17. The liner assembly of claim 10 and including a reinforcing strut assembly extending between said third and fourth sleeves.

18. A combustion liner cap assembly for use in a multi-nozzle combustor of a gas turbine comprising:

a substantially cylindrical first sleeve having a rearward end and a forward end;

a modular premix subassembly including a rear plate secured to the rearward end of said first sleeve, said rear plate having a plurality of nozzle receiving openings therein; and a plurality of premix tubes each having forward and rearward edges, the rearward edges of each premix tube being secured to said rear plate in axial alignment with a respective one of said nozzle receiving openings; and a modular impingement plate subassembly secured within said forward end of said first sleeve, said impingement plate subassembly including an impingement plate having a first plurality of openings therein for receiving respective forward edges of said premix tubes in non-fixed relation thereto, and a second plurality of coolant apertures therein.

19. The combustion liner cap assembly of claim 18 and further including a liner mounting subassembly comprising a second cylindrical sleeve spaced radially outwardly of said first cylindrical sleeve, a plurality of struts extending between and fixed to said first and second sleeves, and a radial mounting flange adapted to be received within a recess between abutting combustor casing flanges.

20. The liner cap assembly of claim 18 wherein a plurality of nozzle collars extend rearwardly of said rear plate, each aligned with a respective one of said rear plate nozzle openings.

21. The liner cap assembly of claim 20 wherein each of said plurality of nozzle collars are mounted to said rear plate so as to permit movement relative to said rear plate.

22. The liner cap assembly of claim 21 wherein each of said nozzle collars is mounted to said plate by a plurality of retaining tabs fixed to said rear plate.

23. The combustion liner cap assembly of claim 18 wherein said impingement plate has a center opening fitted with a center cup.

24. The combustion liner cap assembly of claim 18 wherein said impingement plate is provided with a plurality of cooling apertures.

* * * * *